US006216649B1

(12) United States Patent
Laydera-Collins

(10) Patent No.: US 6,216,649 B1
(45) Date of Patent: Apr. 17, 2001

(54) LOW EMISSION TWO-CYCLE INTERNAL COMBUSTION ENGINE FOR POWERING A PORTABLE TOOL

(75) Inventor: Imack Laydera-Collins, Fort Mill, SC (US)

(73) Assignee: Adventech Corporation, Benton, LA (US)

( * ) Notice: Subject to any disclaimer, the term of this patent is extended or adjusted under 35 U.S.C. 154(b) by 0 days.

(21) Appl. No.: 09/314,765

(22) Filed: May 19, 1999

(51) Int. Cl.[7] ..... F02B 33/22
(52) U.S. Cl. ..... 123/70 R; 123/65 A
(58) Field of Search ..... 123/68, 70 R, 123/65 A, 65 B

(56) References Cited

U.S. PATENT DOCUMENTS

| | | | | |
|---|---|---|---|---|
| 1,168,425 | | 1/1916 | Rosenhagen . | |
| 1,411,384 | | 4/1922 | Sehaffer . | |
| 1,609,371 | | 12/1926 | Leissnier . | |
| 1,698,757 | | 1/1929 | Kjellberg . | |
| 1,856,048 | | 4/1932 | Ahrens . | |
| 2,150,185 | | 3/1939 | Phillips . | |
| 3,730,148 | | 5/1973 | Bagby . | |
| 3,934,562 | | 1/1976 | Isaka . | |
| 4,079,705 | | 3/1978 | Büchner . | |
| 4,191,138 | | 3/1980 | Jaulmes . | |
| 4,276,858 | | 7/1981 | Jaulmes . | |
| 4,458,635 | | 7/1984 | Bersley . | |
| 4,506,634 | * | 3/1985 | Kerrebrock | 123/68 |
| 5,383,427 | | 1/1995 | Tuggle . | |
| 5,558,057 | | 9/1996 | Everts . | |
| 5,586,523 | | 12/1996 | Kawahara . | |
| 5,615,644 | | 4/1997 | Nuri . | |
| 5,682,845 | | 11/1997 | Woody . | |
| 5,722,355 | | 3/1998 | Ekdahl . | |
| 5,735,250 | | 4/1998 | Rembold . | |
| 5,758,611 | | 6/1998 | Collins . | |
| 6,026,769 | * | 2/2000 | Anbarasu et al. | 123/70 R |

FOREIGN PATENT DOCUMENTS

| | | | | |
|---|---|---|---|---|
| 515577 | * | 11/1952 | (BE) | 123/70 R |
| 908916 | * | 11/1945 | (FR) | 123/68 |
| 1084655 | * | 7/1954 | (FR) | 123/70 R |
| 434901 | * | 5/1948 | (IT) . | |

OTHER PUBLICATIONS

"The High Speed Two–Stroke Petrol Engine" by P. Smith, p. 50–51.

(List continued on next page.)

*Primary Examiner*—Noah P. Kamen

(57) ABSTRACT

A low emission two-cycle internal combustion engine for powering a portable tool is provided. The two-cycle engine comprising a cylinder block containing two parallel cylinders adjacent to each other receiving two reciprocating pistons. One cylinder in cooperation with the power piston, operates as the power source. The second cylinder in cooperation with the slave piston, operates as a volumetric fuel pumping system. Both cylinders centerlines lying in a plane perpendicular to a crankshaft. The cylinder block is disposed over an engine block containing the crankshaft and a crankcase. The two pistons are connected by a connecting rod to a common crankpin. The kinematics of this engine leads to a considerable advance of the slave piston in relation to the power piston, resulting in a significant higher pressure within the pump cylinder than into the power cylinder during the compression period. The combustion gasses are evacuated by pure air compressed into the crankcase through the scavenging ports. After the exhaust port closes, a rich fuel/air mixture is progressively introduced into the power piston by the pumping action of the slave piston. This fuel/air mixture is introduced into the combustion chamber of the power cylinder through a fuel transfer port communicating the upper portion of both cylinders and through a unidirectional valve located at the end of such transfer port. Because the injection occurs after the piston has closed off the exhaust port, virtually no unburned fuel escapes, therefore, HC emissions are greatly reduced and fuel economy is enhanced.

20 Claims, 11 Drawing Sheets

OTHER PUBLICATIONS

"Breathing In", Motorcycle Magazine Aug. 1993 by D. Blanchard, pp. 44–48.
"Back to the Future Two–Strokes" By K. Cameron Cycle Magazine, May 1990–pp. 67–71, 87.
"History of the Internal Combustion Engine" ASME Ice vol. 8 p. 14–15 Oct. 15, 1989.
"Future Motorcycle Emissions Technology" R. Grable "Rider Magazine" Jun. 1993 p. 60–63.
The Potential of Small Loop–Scavenged, Spark Ignition Single Cylinder Two–Stroke Engines by F. Laimbock SAE SP–847 1991 910675.
"Fast Injection System: Piaggio Solution for ULEV 2T SI Engines", By M. Nuti. 1997. SAE.
"Two–Stroke Power Units." By P.E. Irving 1967 pp. 20–25.
Introduction to Internal Combustion Engines. pp. 92–96, 277–291 Taylor & Taylor 1962.
Two–Stroke Engine Technology in the 1990's by Floyd Wyczalek, SAE 910663 Oct. 1990.
"Emissions & Fuel Comsumption Reduction in a Two Stroke Engine Using Delayed–Charging" by P. Rochelle, 1995 SAE Paper 951784.
"Application of IAPAC Fuel Injection for Low Emissions Small Two–Strokes Engines" SAE 1995 P. Duret SAE 951785.

* cited by examiner

LOW EMISSION TWO-CYCLE INTERNAL COMBUSTION ENGINE FOR POWERING A PORTABLE TOOL

FIELD OF THE INVENTION

This invention pertains to a small displacement two-cycle internal combustion engine with a mechanical direct fuel injection system for powering portable power tools and equipment used in forestry, lawn, garden and construction, as well as small vehicles like scooters and mopeds.

BACKGROUND OF THE INVENTION

The advantages of two-cycle engines are well known. They are simple, have a high power/weight ratio, can be manufactured at a low cost and are very reliable. These characteristics have made the two-cycle engine the preferred power source for hand held appliances such as chain saws, line trimmers, leaf blowers and the like. However, the necessity for ensuring complete combustion and minimization of scavenging losses of the engine present significant problems.

Most of the modern two-cycle engines employ three basic types of scavenging systems: Loop scavenging (FIG 1*a*), cross scavenging and uniflow scavenging (FIG. 2). The loop scavenging system, being the most popular due to its simplicity and effectivity. The scavenging ports direct a stream of air/fuel mixture into the cylinder, creating a loop like flow pattern, aiming to evacuate the remaining gases left from the combustion cycle. Despite the numerous improvements implemented through time in the loop scavenging system since its invention by Schnuerle in 1926, an unavoidable portion of unburned fuel is always released into the atmosphere as scavenging losses. This reduces the fuel efficiency of the engine and creates atmospheric pollution.

Pending and existing exhaust emission regulations imposed by the EPA and CARB on non-road equipment up to 19 Kw including lawn and garden equipment powered by internal combustion engines, strongly demand reduction in noxious substances such as hydrocarbons, nitrous oxides and carbon monoxide, in exhaust gas discharged mainly by two-cycle engines used on power tools and other lightweight applications.

In order to meet such existing and pending air pollution exhaust emission regulations, for such hand held two-cycle engines, much effort and expense has been directed in the last several years towards improving scavenging and fuel delivery systems for such engines to enable the same to meet such stricter exhaust pollution requirements, especially in regard to the unburned hydrocarbon (HC) component. In this field, the major hurdle has been to achieve this result at an affordable cost to the end user of such relatively low cost equipment, while also insuring that such engine improvements do not compromise the easy portability requirements for such engine powered handheld appliances and equipment.

New generations of lightweight four-cycle engines with low hydrocarbon emissions are among the technologies being developed for powering handheld portable tools. Their manufacturing cost, in-use emissions deterioration, serviceability and low power/weight ratio are still problems to resolve. An example of this technology is illustrated by U.S. Pat. No. 5,558,057.

Catalytic converters, fuel injection, uniflow scavenging and stratified scavenging are among the technologies aimed to reduce exhaust emissions in modern two-cycle engines.

Catalytic converters are well known from automotive applications as an efficient method to reduce exhaust emissions. The hydrocarbon reduction is a result of a chemical reaction that produces oxidation of exhaust gases. Unfortunately, the catalyst materials deteriorates with use, do not completely eliminates the hydrocarbon emissions and generates unwanted amounts of heat, factors that are not very appealing in small engines.

Uniflow scavenging is another method used to improve the fuel efficiency and to reduce the scavenging losses incurred in loop scavenged two-cycle engines. Uniflow engines were successfully used in the 30's on automotive and diesel engines by Trojan, Garelli, DKW, Puch, TWN and EMC. Longer scavenging loop and clever asymmetric geometry allowed the port timing of some split singles to be juggled so that the exhaust closes before charging has finished, which all helped to keep the fresh mixture out of the exhaust increasing the fuel efficiency. These advantages of uniflow scavenging are used for reducing exhaust emissions in modern applications. Examples of this method are provided by U.S. Pat. Nos. 4,079,705, 5,722,355 and 5,758,611

Another well-known approach successfully used to reduce scavenging losses is direct fuel injection systems. Thanks to recent electronic technology developments, electronic fuel injection is presently widespread as the preferred fuel delivery system in automotive applications. Unfortunately, this technology has not been commercially developed in low cost lightweight applications due to the electrical hardware required and its associated high cost. Also, the complexity of a fuel injection system to manage the small fuel volumes required at idle and at full throttle conditions, has remained as another serious obstacle to successfully implement direct fuel injection systems in hand held appliances powered by two-cycle engines.

Long before electronic fuel injection was technologically possible, mechanical fuel injection systems were widely used on diesel engines and on high performance gasoline engines. Many attempts have been made to adapt mechanical fuel injection to small engines, but cost and functional factors have been significant barriers to these systems.

During last century, the earliest efforts with regard to the development of a mechanical fuel injected two-cycle engine, was the Clerk engine. This engine used a mechanical pump to transfer air/fuel mixture to a working cylinder. Since then, other engine inventors followed the same basic Clerk's principles in their engines. Most of these early inventions were originated from diesel engines concepts where high compression ratios are necessary. The U.S. Pat. No. 607,276 by the Joseph Reid Gas Company issued in 1898 describes an engine with a pump cylinder and a power cylinder used for oil well service, where the pump cylinder was used to transfer natural gas mixed with air into the working cylinder. Another early application of volumetric fuel pumps in two-cycle engines were the supercharged racing engines by DKW and Schilha in the early 1900's.

The U.S. Pat. No. 1,168,425 by Rosenhagen issued in 1916 describes a typical example of prior art engines using a volumetric pump to transfer the air/fuel mixture into the working cylinder. This engine uses timing differences based on the radial positioning of a pump piston in relation to a power piston to create anticipated upward motion of the pump piston thus creating a pressure differential between both cylinders. Complicated valving and fuel passages, low speed, large air/fuel paths, high pumping losses and lack of lubricating means prevented the success of this invention seeking improved volumetric efficiencies.

Another examples of use of volumetric pumps to transfer a combustible mass to a working cylinder is described on patents by Houyez (France 908,916), Silander (Belgium 515,577), Kerrebrok (U.S. Pat. No. 4,506,634), Voisin (France 1,084,655) and Lepore (Italy 434,901) among others.

The aforementioned prior art on two-cycle engines with volumetric pumping systems was intended for low speed, large engines, capable of absorbing large pumping losses, high levels of vibration and with a multiplicity of components not tolerated by small hand held engines with low levels of power and inexpensive manufacturing. These prior art engines did not succeed due to the competitiveness of loop scavenged two-cycle engines in an era where exhaust emissions were unimportant. Therefore, there is a need in the art for a small high performance two-cycle engine with very low hydrocarbon emissions that can be successfully fabricated with current mass production methods at a cost affordable for such inexpensive applications.

A modern example of air assisted mechanical fuel injection systems using volumetric fuel pumps is provided by the FAST system. A volumetric pump driven by a secondary crankshaft introduces a rich air/fuel mixture into a power cylinder. The Italian manufacturer Piaggio successfully uses this system to reduce exhaust emissions in motor scooters. As it will be learned further in the description of this invention, the engine object of the present invention uses equivalent physical principles to those used by the FAST system to gain volumetric efficiency and reduced hydrocarbon emissions. The engine object of the present invention provides the same effects, but thanks to the use of a greatly simplified mechanical system, it allows a lightweight and compact construction as well as reduced mechanical losses that allows its utilization on portable tools.

It is obvious to the person skilled in the art, that the prior art of air assisted mechanical fuel injection in two-cycle engines, often has a complex and bulky construction not desirable for lightweight applications and hand held portable tools where compactness, low weight, low cost and low emissions are the dominating factors.

SUMMARY OF THE INVENTION

The object of the present invention is to provide a lightweight, compact and economical two-cycle engine that offers a power/weight ratio similar to conventional prior art loop-scavenged two-cycle engines but with very low scavenging losses, thus, with very low exhaust emissions. Its simplicity and purposeful construction substantially reduce all the problems found in prior art two-stroke air-assisted fuel injection engines allowing at the same time a low manufacturing cost as required in hand held gas powered tools as those used in construction, forestry, lawn and garden applications.

A two-cycle, crankcase scavenged internal combustion engine is provided comprising a siamese cylinder in which two pistons reciprocate parallel to each other. One of the cylinder bores contains the exhaust ports, intake ports, scavenging ports and a combustion chamber as in a typical single cylinder two-cycle engine. The combustion chamber is provided with a spark plug and an inlet valve. This cylinder bore in cooperation with a piston provides the power cycle. The second cylinder bore in cooperation with a slave piston provides the pumping action necessary to introduce a rich air/fuel mixture into the power cylinder. This second cylinder bore has at its top end an inlet valve and a passage communicating to the power cylinder. This communicating passage is positioned in order to obtain the smallest possible dead volume. The two pistons are connected to a common crankshaft by single or individuals connecting rods. This geometry provides an asymmetric motion of the pistons, which enables the timing of the pump piston to be considerable advanced in relation to the power piston. This timing advance produces a significant pressure differential between both cylinders, which is utilized to pump a rich air/fuel mixture into the power cylinder.

Another advantage of the asymmetric location of the crankshaft in relation with the centerline of the power cylinder is the reduction of mechanical friction. In typical two-cycle engines, during the power stroke the connecting rod angle in relation to the cylinder centerline determines the amount of the force applied by the piston skirt over the cylinder surface. This reaction is called the major thrust force. Significant friction force is generated over the major thrust surface and it is directly proportional to the angle between the connecting rod and the cylinder centerline. This frictional force produce heat and wear. In the engine object of the present invention the rod angle is maintained to small values during the expansion cycle. This allows maximizing the piston force transmitted to the crankshaft, while reducing the heat and wear generated by the friction .

With the arrangement described above, the siamese cylinder two-cycle engine operates as a typical loop scavenged engine within the power cylinder, but with significant reduction of pollutants into the exhaust gases. This significant reduction of pollutants into the exhaust gases is accomplished by the combined action of several improvements. As aforementioned, in typical two-cycle engines, during the scavenging period a portion of scavenging gases always escape through the exhaust port; as the engine object of the present invention is also a loop scavenged two-cycle engine within the power cylinder, it will have scavenging losses. But due to the use of pure air to scavenge the exhaust gases, some of this air escaping through the exhaust port as scavenging losses, mixes with the exhaust gases, which contains high levels of carbon monoxide. As a result of this chemical reaction, the excess air into the exhaust gases stream oxidizes significant amounts of carbon monoxide. The carbon monoxide is then transformed into carbon dioxide, which is a harmless gas.

As the air/fuel mixture is injected directly into the combustion chamber of the power piston after the exhaust port has been closed, virtually there are no raw fuel losses into the exhaust gases stream, therefore hydrocarbon emissions are almost eliminated. Another advantage not obvious with the unfamiliar with the combustion process, is the reduction of fuel droplet size caused by fuel atomization into the carburetor venturi and subsequent expansion through the injection valve into the combustion chamber of the power cylinder. The final expansion process causes a droplet size much smaller than in current carbureted systems or direct fuel injection systems, therefore an improved and complete combustion process is enabled due to the increased interaction between fuel and air molecules. Another advantage yet, is the resulting stratified volume of rich air/fuel mixture injected around the spark plug at the end of the compression cycle. This stratification is known to promote combustion initiation and flame propagation.

As the engine object of the present invention is a combination of a traditional two-cycle engine with an integrated mechanical fuel injection system, the configuration of the two-cycle engine may be configured as other two-cycle engine including reed valve systems, piston ported systems, rotary valve systems, and combination thereof without departing from the spirit of the present invention.

The preferred embodiments of this invention have several inventive aspects, which jointly contribute to the main functional object of the invention: to reduce exhaust emissions and improve fuel efficiency while preserving the desired features of a typical two-cycle engine. One of the embodiments describe the use of a low cost and compact air assisted mechanical fuel injection system adapted to a small two-cycle engine to power a portable tool. Another embodiment describes the use of the asymmetrical timing well known in uniflow engines, typically used at the bottom dead center to create a pre-outlet of the exhaust port. Instead, it is used in the present invention at the top dead center to create a pressure differential for allowing fuel injection. Another further embodiment shows how the general construction and design of the engine allows simple manufacturing and low parts count, not typical for prior art air assisted mechanical fuel injected engines.

The invention will be better understood and further objects and advantages thereof will become more apparent from the ensuing detailed description of preferred embodiments taken in conjunction with the drawings.

BRIEF DESCRIPTION OF THE DRAWINGS

The invention will be described in closer detail in the following by means of various embodiments thereof with reference to the accompanying drawings, wherein identical numeral references have been used in the various drawing figures to indicate identical parts.

DETAILED DESCRIPTION OF THE PREFERRED EMBODIMENTS.

The embodiments of the present invention will now be explained with reference to the accompanying drawings.

Figure 2:
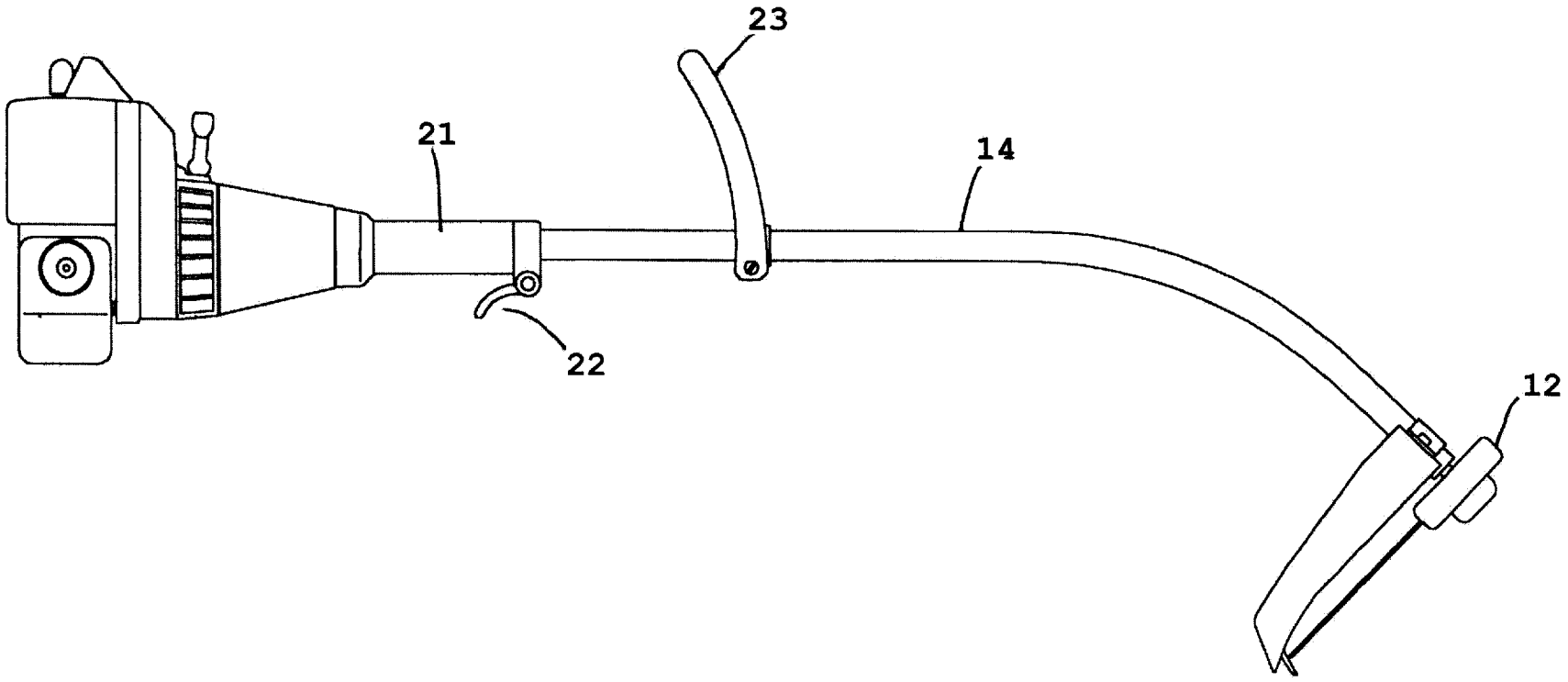
FIG. 2 is a side view of a power tool having a low emission two-cycle engine embodying the present invention.
Figure 3:
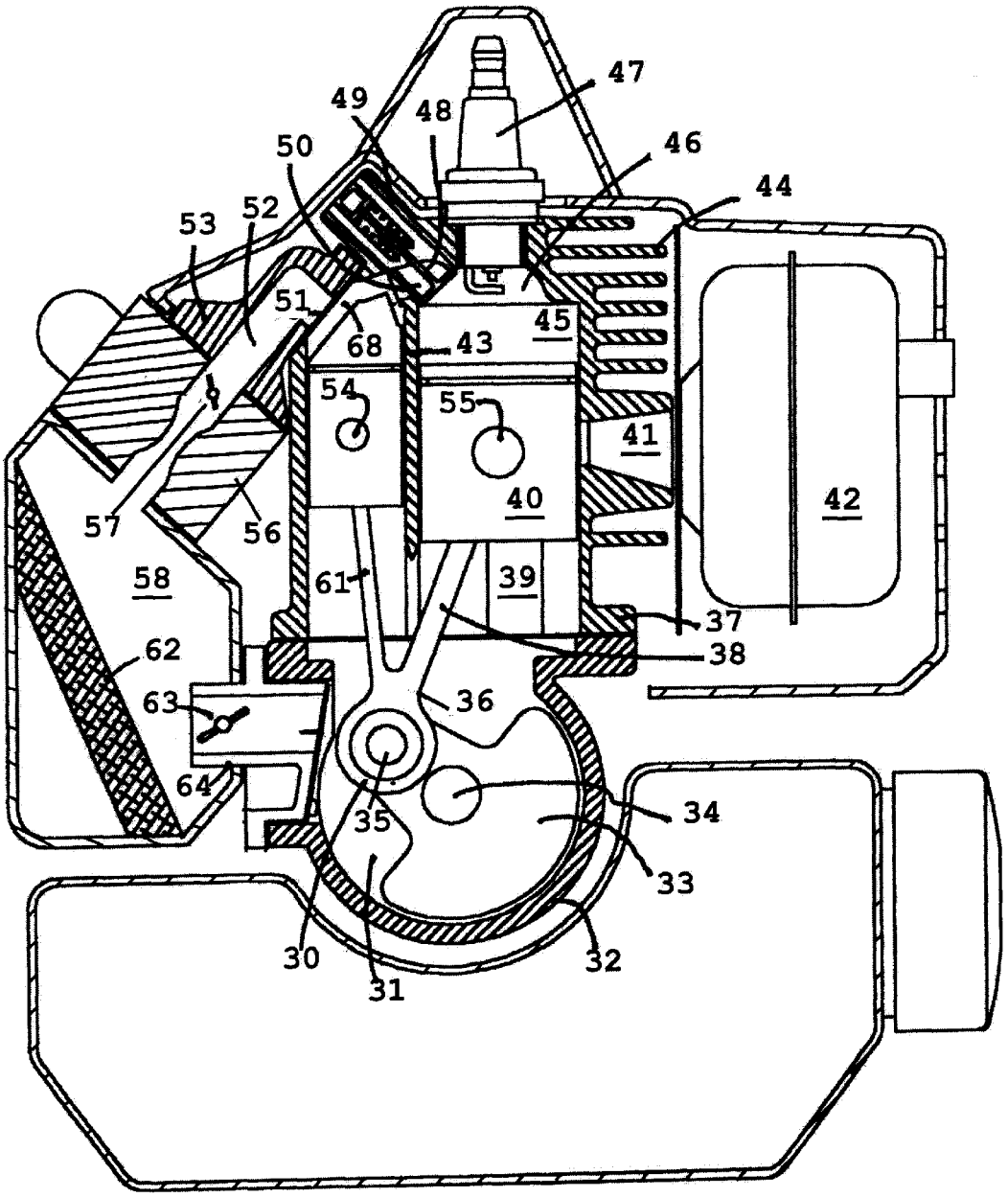
FIG. 3 is a cross sectional view of the engine embodying the present invention. The sectional view is through the engine's cylinder centerline.
Figure 4:
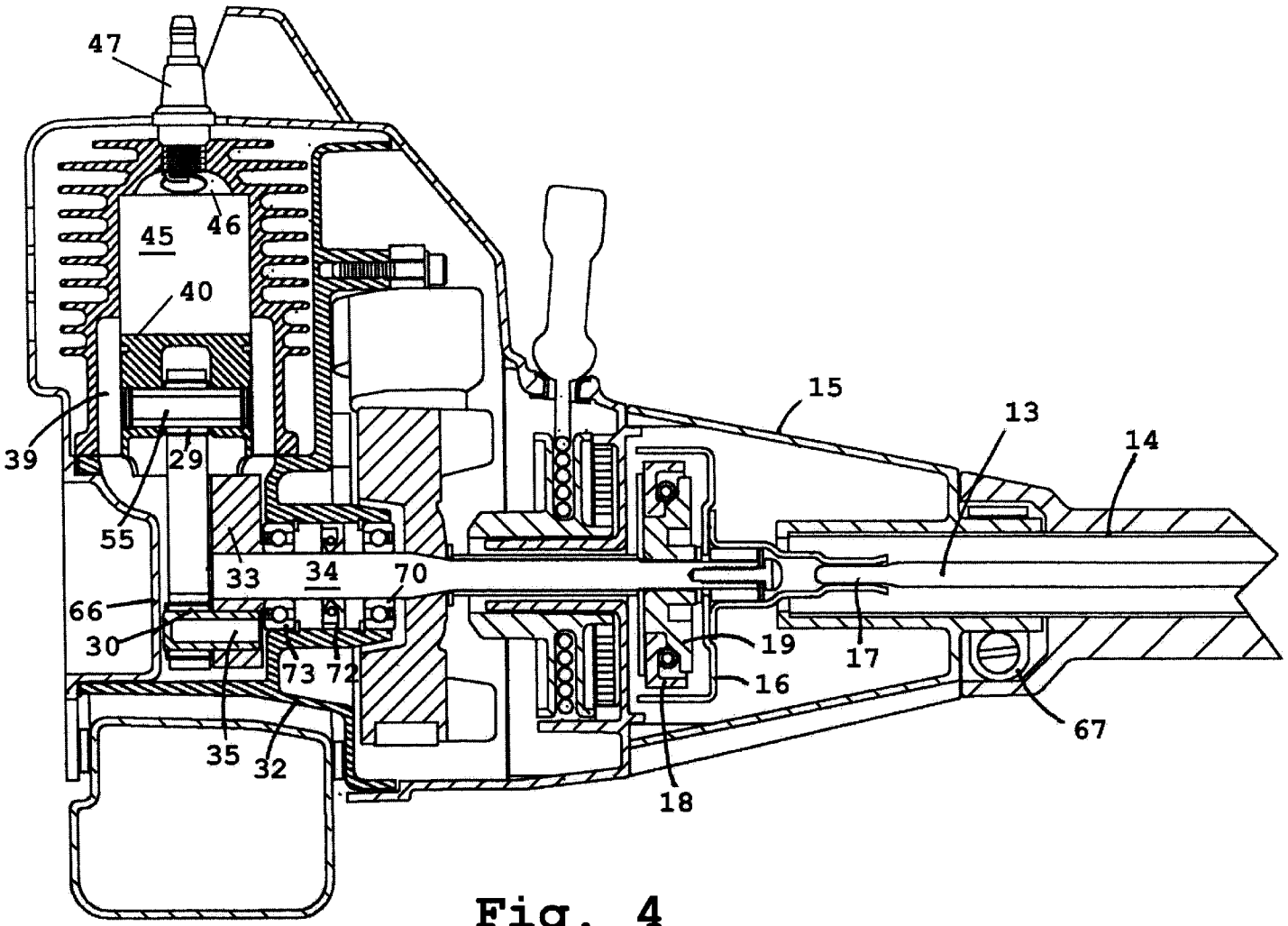
FIG. 4 is cross sectional view of the engine of FIG. 3. This sectional view is through the crankshaft axis and the cylinder axis.

Referring to FIGS. 2, 3 and 4, the invention is described in connection with a gas-powered line trimmer. The gas-powered trimmer is intended to be representative of a hand held portable tool where the engine object of this invention may be used as the power source. Some of the commonly known portable tools where this low emission two-cycle engine may be utilized are chain saws, blowers, cultivators, edgers, hedge trimmers, snow blowers, and the like. It also may be understood that the use of this engine is not limited to any other applications where the use of a conventional two-cycle engine is advantageous.

In a known manner, the low emission two-cycle engine object of this invention is used to drive the work implement of the gas powered line trimmer shown by FIG. 2, which is represented by a cutting head 12. The rotational power is transmitted to the cutting head 12 by a flexible shaft 13 disposed into a rigid tube 14. The engine housing 15 is secured to the tube by a clamp 67 into the nose portion of an engine housing 15. At the end of the pocket where the tube is nested inside the nose of the engine housing 15, is located a clutch drum element 16 including a coupling section 17 to receive the end of a drive shaft 13. Disposed into the clutch drum 16 is a clutch shoe assembly 18 and a clutch hub 19. The clutch hub 19 and the clutch shoe assembly 18 are mounted on a crankshaft 34. At low engine speeds the clutch drum 16 is disengaged from the cutting head 12. When the engine reaches certain rotational speed, the clutch shoe 18 engages the drum 16 and couples the engine to the work implement represented by the cutting head 12. The gas-powered trimmer has two handles 20 and 21 for a person to hold and maneuver the trimmer to cut vegetation. Near the main handle 20 is located a throttle control 22 for a person to control the cutting speed of the work implement.

FIG. 3 shows a cross section through the cylinder bores and FIG. 4 shows a longitudinal section through the crankshaft of the low emission two-cycle engine object of this invention comprising: a cylinder block 37 including Siamese cylinders and a combustion chamber 46. A first cylinder called hereunto the power cylinder 45 and a second cylinder called hereunto the pump cylinder 61. Both cylinder bores are parallel to each other and spaced by a common wall 43. The plane, which contains the centerline of the cylinder bores, is perpendicular to the crankshaft axis. The cylinder block 37 is preferably cast as a single piece of aluminum alloy.

Figure 10:
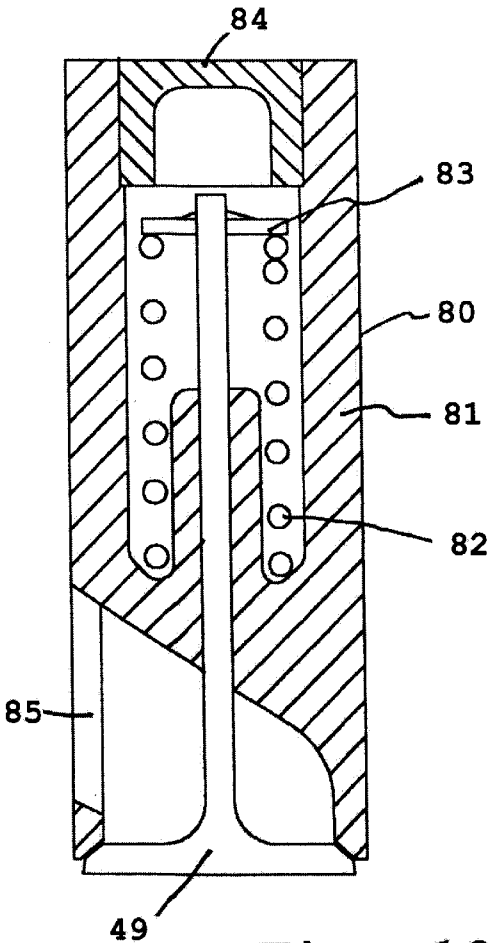
FIG. 10 shows a cross sectional view of the transfer valve unit.

Cooling fins 44 for dissipating the heat generated by the engine surround the cylinder block 37. Disposed into the cylinders are two pistons: a power piston 40 and a slave piston 59, which are axially guided into the power cylinder 45 and into the pump cylinder 61 respectively. The power cylinder 45 in cooperation with the power piston 40 provides the power cycle. The power cylinder 45 comprises the exhaust port 41, the scavenging ports 39 and a combustion chamber 46. It will be further described that the power cylinder 45 may also comprise at least a crankcase intake port laterally opened into the cylinder wall when the engine is configured with a piston ported induction system. At the top portion of power cylinder 45 is provided a combustion chamber 46 defined by the end face of the power piston 40 dome and the end surface of the power cylinder 45. Provided inside the combustion chamber 46 is a spark plug 47 face and a transfer valve 48 face. The spark plug 47 is mounted to the cylinder block by threaded means and extends into the combustion chamber 46. The transfer valve 48 is spring loaded by means of a compression spring 79 (FIG. 10). When the cylinder block 37 is manufactured in one piece, due to the small bore size, it may be difficult to machine and place the transfer valve from the inside of the cylinder. For such purposes, a transfer valve bore 49 is drilled from the outside of the cylinder extending into the combustion chamber 46. This allows the precise placement of a transfer valve unit 77 shown in FIG. 10. This transfer valve unit is an integral part consisting of a transfer valve body 78, a poppet type transfer valve 48, one compression spring 79, spring retaining means 80 and a cap 81. The compression spring 79 maintains the transfer valve 48 closed and it is calibrated to open when the pressure differential between both cylinders reaches predetermined levels. The cap 81 seals the open end of the transfer valve body 78 and prevents any fluids from escaping to the atmosphere. The transfer valve unit 77 has a lateral opening 82 that communicates the power cylinder 45 with a transfer passage 50. The transfer passage 50 communicates the power cylinder 45 with the pump cylinder 61. This transfer passage 50, allows the load of rich art/fuel mixture compressed into the pump cylinder 61 to be transferred into the combustion chamber 46 of the power cylinder 45 after biasing the spring force acting over the transfer valve 48.

The power piston 40 design and construction is identical to those used in conventional two-cycle engines.

Figure 9:
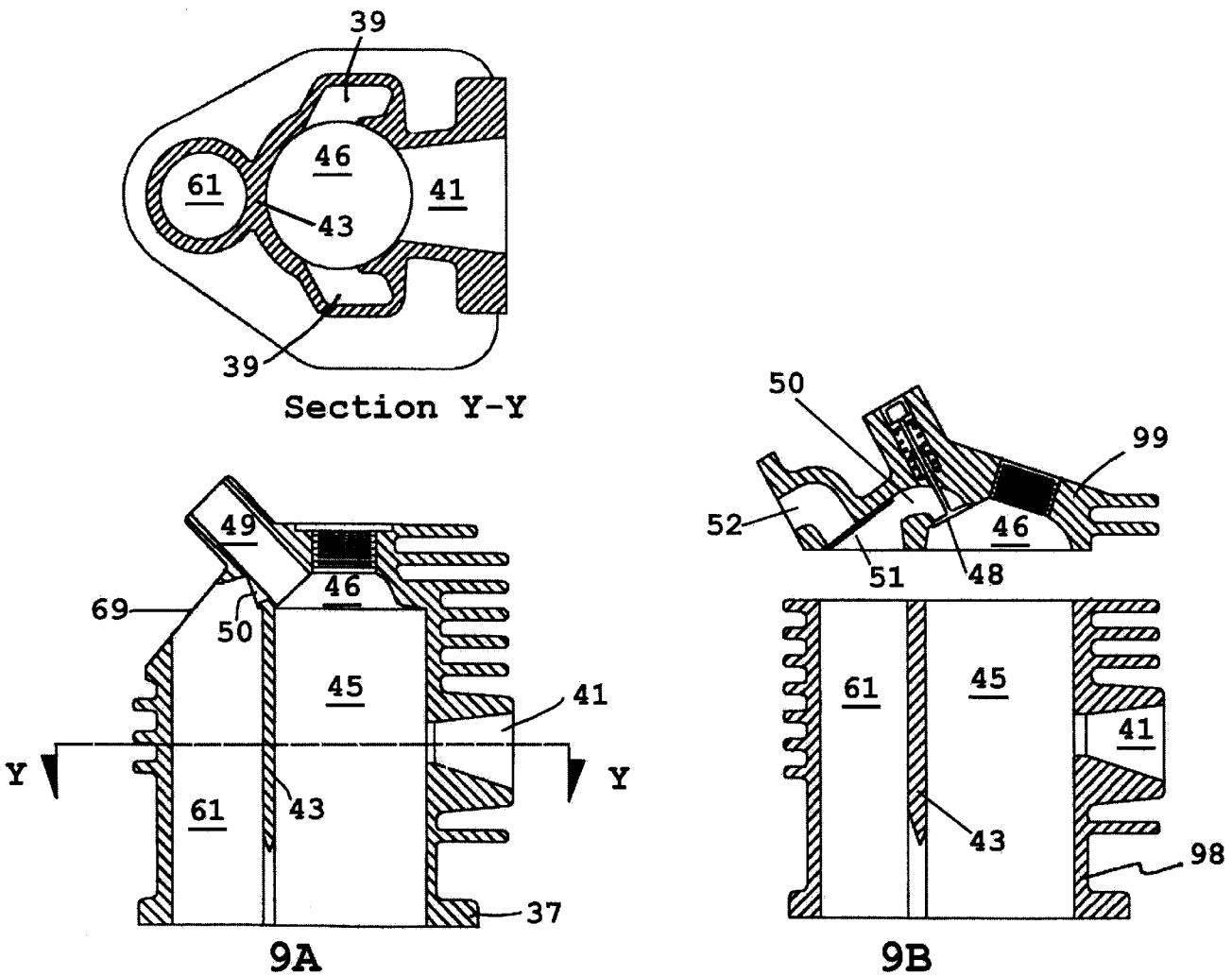
FIG. 9 illustrates the constructive details of a one-piece cylinder head and a cylinder with detachable head.
Figure 11:
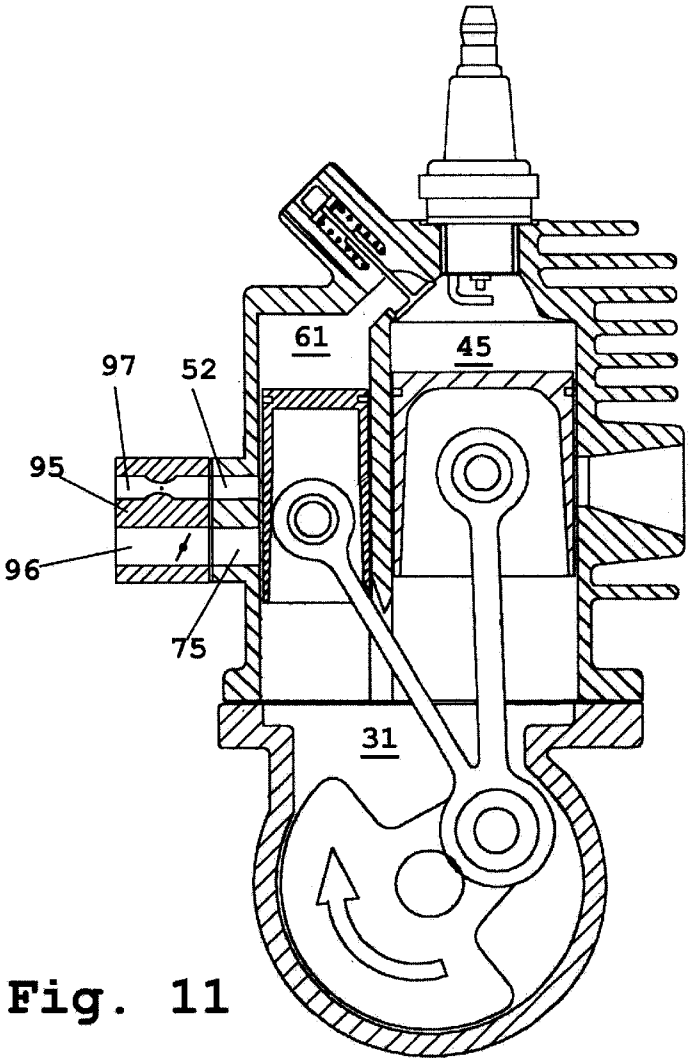
FIG. 11 shows an engine with the crankcase induction and pump induction controlled by piston displacement.

As shown by FIG. 9 and FIG. 11, to simplify manufacturing, the transfer passage 50 is purposely located to be drilled from the outside of the cylinder block 37 through the inlet valve block mounting opening 69 at the top of the pump cylinder 61 or through the spark plug opening if a piston ported configuration is used. Another configuration that minimizes manufacturing cost is to locate the transfer valve bore 49 intersecting the nearest corner of the pump cylinder 61. It is very important that the transfer passage 50 is designed with the minimum possible length and volume in order to reduce the dead spaces during compression, which reduces pumping losses.

The pump cylinder 61 in cooperation with the slave piston 59, works as a volumetric pump to transfer a rich air/fuel mixture into the power cylinder 45. Due to the small amounts of rich air/fuel mixture needed for the combustion process into the power cylinder 45, the diameter of the pump cylinder 61 is substantially smaller in size than the power cylinder 45. The diameter of the pump cylinder 61 is inversely proportional to the degree of concentration of fuel into the air and must be minimized to reduce pumping losses. The pump cylinder 61 contains a pump chamber 68 defined by the surface of the dome of the slave piston 59, the end surface of the pump cylinder 61 and the face of a inlet valve housing 53. The inlet valve housing 53 includes a reed type inlet valve 51 attached to the surface of the inlet valve housing 53 facing the pump cylinder inlet valve opening 69. The inlet valve housing 53 is disposed over the top portion of the pump cylinder 61. The inlet valve housing 53 comprises an inlet passage 52 for fluid communication of a carburetor 56 with the inlet valve 51. The carburetor 56 is attached to the inlet valve housing 53 at the end opposite to the inlet valve 51. The material of the inlet valve housing 53 has a low coefficient of heat transmission to avoid engine heat migration towards the carburetor 56. For the shown configuration, the angular position of the inlet valve housing 53 in relation to the cylinder axis, allows the convenient location of the carburetor 56 and an air filter box 58. The angular positioning of the inlet valve housing allows also an updraft flow of the air/fuel mixture, avoiding engine flooding and fuel puddles during starting. The fuel inlet valve 51 is a reed type valve with elastic properties urging one of the faces of the valve to lay against the opening of the inlet valve housing 53. When the slave piston 59 starts its descending stroke within the pump cylinder 61, a negative pressure is created, allowing air/fuel at a higher pressure to bias the elastic force acting on the reed inlet valve 51, opening the air/fuel mixture flow into the pump cylinder 61.

As described in FIG. 11, the reed valve inlet system may be configured as a piston ported system where the air/fuel inlet port is located in the side wall of the pump cylinder 61, wherein opening and closing of the air/fuel flow is controlled by the displacement of the upper edge of the slave piston dome. Furthermore, the crankcase inlet port 75 can be also located in the wall of the pump cylinder, wherein opening and closing of the port is controlled by the position of the lower edge of the slave piston 59 skirt. It will be also shown that the crankcase inlet port 75, can be located in the side wall of the power cylinder 45, wherein opening and closing of the port, is controlled by the displacement of the lower edge of the power piston skirt, as in traditional two-cycle engines.

The slave piston 59 has a dome surface that follows closely the shape of the top of the pump cylinder 61 and the inlet valve 51 face. As aforementioned, the reduction of the dead spaces during compression is necessary to reduce compression losses, therefore, increasing engine efficiency. A ring is disposed in the cylindrical portion of the slave piston 59 to prevent the leakage of gases through the clearance space between piston and cylinder. As the slave piston 59 is intended to withstand only compression cycle forces, lightweight materials like aluminum, magnesium or carbon matrix composites can be used to further reduce the weight of the reciprocating masses, which is important to reduce engine vibration. As minimization of vibration and reduction of engine package is necessary, a very short connecting rod is required and cuts into the cylinder walls are necessary to allow space for the connecting rod motion.

The cylinder block 37 is disposed over an engine block 32 containing a crankcase chamber 31 and the main bearings bore. The engine block 32 preferably cast in one-piece of a lightweight material like magnesium or aluminum. The engine block walls and the rear crankcase plug 66 comprise the boundaries of the crankcase chamber 31. The engine block 32 contains the main bearings 70 and 73 on which the crankshaft 34 is rotatively mounted. Attached to the main bearing bore and in between the main bearings 70 and 73 is located a crankcase seal 72 which has the inner lip in contact with the crankshaft 34 to prevent air/fuel leaks. The crankshaft 34 has a counterweight-crank 33 disposed at the end contained into the crankcase 31. A crankpin 35 is eccentrically disposed into the counterweight-crank 33, being parallel to the crankshaft 34. Angularly opposed to the crankpin location is the heavier mass of the counterweight-crank 33, which is used to counterbalance the reciprocating mass of the engine. A connecting rod 36 is rotatively mounted over the crankpin 35 by means of a crankpin bearing 30. One arm of the forked connecting rod 36 called hereunto the main arm 38, connects with the power piston 40, the other arm called hereunto the slave arm 60, connects with the slave piston 59. The connecting rod arms are connected to the slave and power pistons by the wristpins 54 and 55 respectively. Wristpin bearings 29 are sandwiching between the wristpin and the wrispin head eye of each of the connecting rod arms to reduce friction. The wristpins 54 and 55 are parallel to each other and to the crankpin 35.

At the opposite end of the crankshaft 34 containing the counterweight-crank 33, is disposed a flywheel-fan 71, which has three major functions: First, to provide the necessary inertial forces required during the compression cycle. Second, to provide the necessary airflow required for cooling the cylinder block 37. Third, to provide in cooperation with the ignition module the electrical current required for spark generation. The skilled in the art will recognize that many different combinations of crankshaft systems as double supported, double counterweight crankshaft, double supported single counterweight crankshaft, can be utilized without departing from the spirit of the invention.

Figure 5:
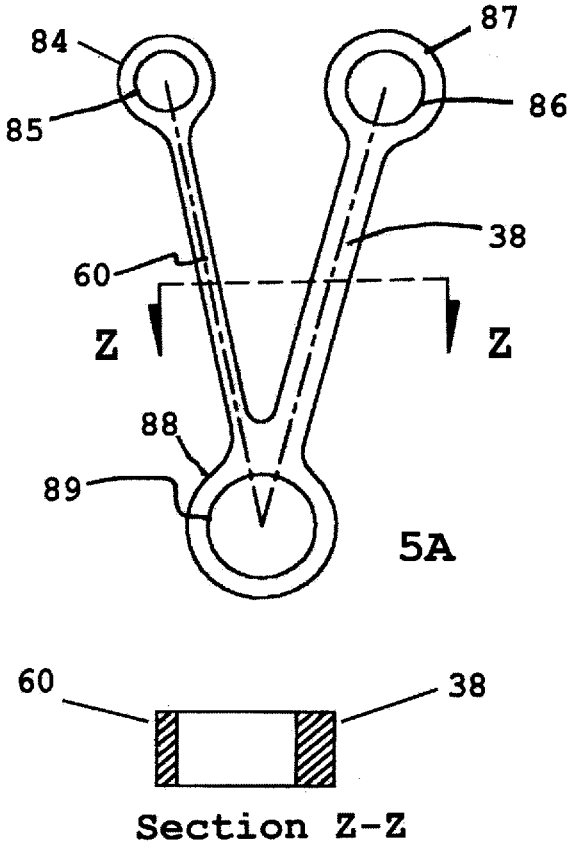
FIG. 5 shows several connecting rod configurations adaptable to the engine object of this invention.
Figure 5:
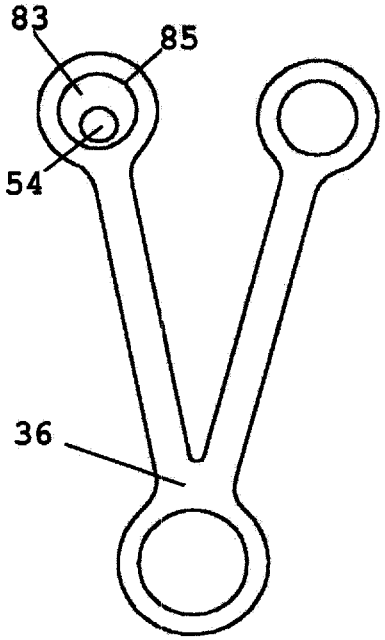
Figure 5:
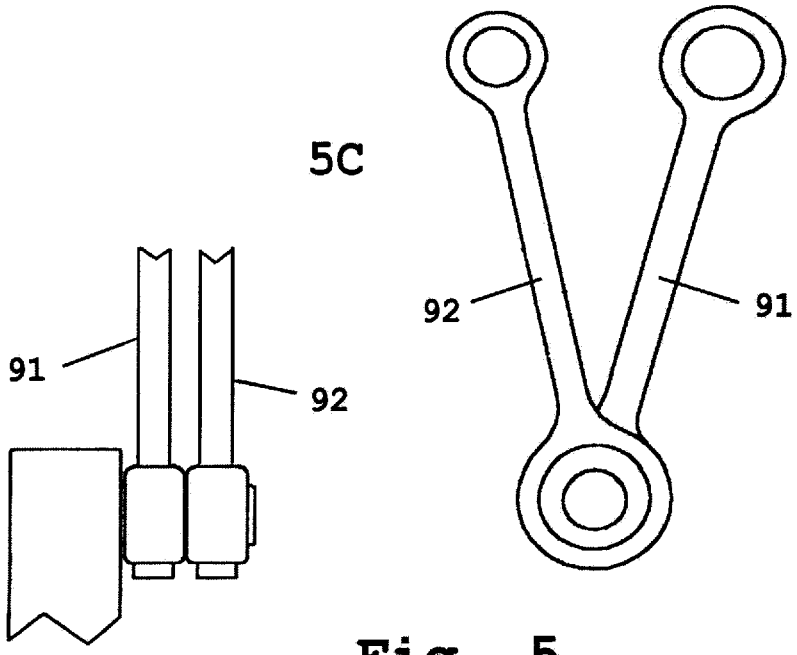

The slave piston 59 is pivotally connected to the crankshaft 34 through the slave arm 60 of the connecting rod 36. The upper portion of the slave arm 60 is connected to the slave piston 59 by means of the wristpin 54. A wristpin bearing 29 is sandwiched between the wristpin-head eye and the wristpin 54. The lower end of the slave arm 60 is attached to the crankpin-head of the connecting rod 36. The neutral axis of this slave arm 60 is coplanar with the plane formed by the crankpin 35 axis and the wristpin 54 for maximum column strength as shown in FIG. 5*a*. Wristpin bearings may be replaced by the bearing surface of the connecting rod arm eye if the specific loads are low.

FIG. 5*a* shows the connecting rod 36 as a one-piece element comprised by a slave arm 60, the main arm 38, the slave arm wristpin head 84, the slave arm wristpin eye 85, the main arm wristpin-head 86, the main arm wristpin-eye 87, the crankpin-head 88 and the crankpin-eye 89. The main arm 38 is attached to the power piston 40 and the slave arm 60 is attached to the slave piston 59. The neutral axis of both arms must be in the same plane of the crankpin 35 axis. This is very important to avoid twisting forces around the crankpin during the expansion cycle. At this point, when the main arm 38 is under high compressive forces produced by the combustion gases expansion, the slave arm 60 is under tensile forces due to the suction applied by the slave piston 59 into the pump cylinder 61.

A typical problem found in twin parallel cylinder uniflow engines is the variation of the wristpin centers when the angular position of the connecting rod changes during the crankshaft rotation. Methods to compensate for wristpin distance variation were used on early uniflow engines during the 1930's. These engines used a forked connecting rod in which the arms were allowed some flexibility (Trojan) or mother-slave rod configurations with intermediate linkage (Zoller). These engines also had very long connecting rods into a large crankcase with very low pumping efficiency. In the engine object of the present invention, like in uniflow engines, the variation of wristpin centers is a problem to overcome. By allowing flexion of one of the connecting rod arms the same results are achieved. The connecting rod arms are designed as short as possible to minimize crankcase volume to maximize the pumping efficiency but yet must be flexible enough to accommodate the variation of the wristpin centers.

As the power piston 40 is exposed to the force of the combustion gases, the main arm 38 is designed for high column strength to withstand such compressive stresses similar to conventional two-cycle engines. On the other hand, the slave piston 59 is substantially smaller than the power piston 40, it is only exposed to compression cycle gas pressure, therefore, the magnitude of the force transmitted to the slave arm beam 60 is relatively low, allowing to design the slave arm beam with a fairly thin section. This thin section allows good levels of flexibility without reaching the fatigue limits for the material. The flexion of the slave arm allows accommodating the wristpin distance variations, while the main arm is substantially rigid.

FIG. 5*a* also shows the cross sectional view of both connecting rod arms. This view illustrates how the moment of inertia in the flexing plane of the slave arm is much smaller than the moment of inertia of the main arm. This orientation allows the minimization of the flexural stresses while allowing good column strength.

In its natural state, the position of the slave arm wristpin-eye 85 center in relation with the main arm wristpin-eye 87 center, is in an intermediate position between the maximum and minimum distance variation between wristpin centers. For instance if the maximum wristpin distance is 35 mm and the minimum distance is 34 mm., the natural state distance between both wristpin eye centers must be around 34.5 mm. This allows minimum bilateral flexion of the slave arm during operation. By allowing minimum flexural stresses, the reaction force over the wristpins is also reduced, therefore, the friction force between piston and cylinder is also reduced.

The connecting rod is preferably made of a lightweight metal in order to reduce the engine vibration. As previously mentioned, the length of the connecting rod is maintained to a minimum in order to reduce the dead spaces into the crankcase, necessary to increase the scavenging gases pressure and to avoid crankcase pumping losses. Alternate connecting rod designs are possible without deviating of the main scope and spirit of the present invention as shown by FIG. 5*b* and 5*c*.

Another embodiment of the present invention is a method to compensate for the wristpin distance as shown in FIG. 5*b*. An eccentric collar [100 ] 83 is sandwiched between slave piston wristpin 54 and the slave arm wristpin-head eye 85. Due to the eccentricity of the wristpin mounting location in relation to the center of the wrispin-head eye center, little change in distance in the plane parallel to both wristpins are compensated by rotation of the eccentric collar 83 within the wristpin-head eye 85. The eccentric collar 83 is located in such a way that its outside diameter is in contact with the internal diameter of the wristpin-head eye 85. Its internal diameter which is eccentrically located in relation with its outside diameter, is in contact with the wristpin 36. Proper lubrication is required to reduce friction forces when the eccentric collar 83 is in direct contact with the cooperating surfaces. Needle bearings may be used over the surfaces in contact to further minimize friction between sliding surfaces without deviating of the main scope of the invention.

FIG. 5*c* shows two individual connecting rods achieving the same function as the one piece forked connecting rod 36. Both connecting rods 91 and 92 are mounted over the same crankpin 35. The centerline of the power cylinder 45 and the pump cylinder 61 is offset in such a way that the plane of motion of the power piston 40 and the slave piston 59 are in the same plane of the centerline of its corresponding rod. It is also possible to connect both rods in a mother-slave rod configuration as used in multi-cylinder radial engines, but this will add prohibitive vibration, weight and cost to the engine.

The cylinder block 37 and the engine block 32 has been described as different elements, but it is always possible combine them as a one-piece casting in configurations where manufacturing cost is the main concern.

Figure 6:
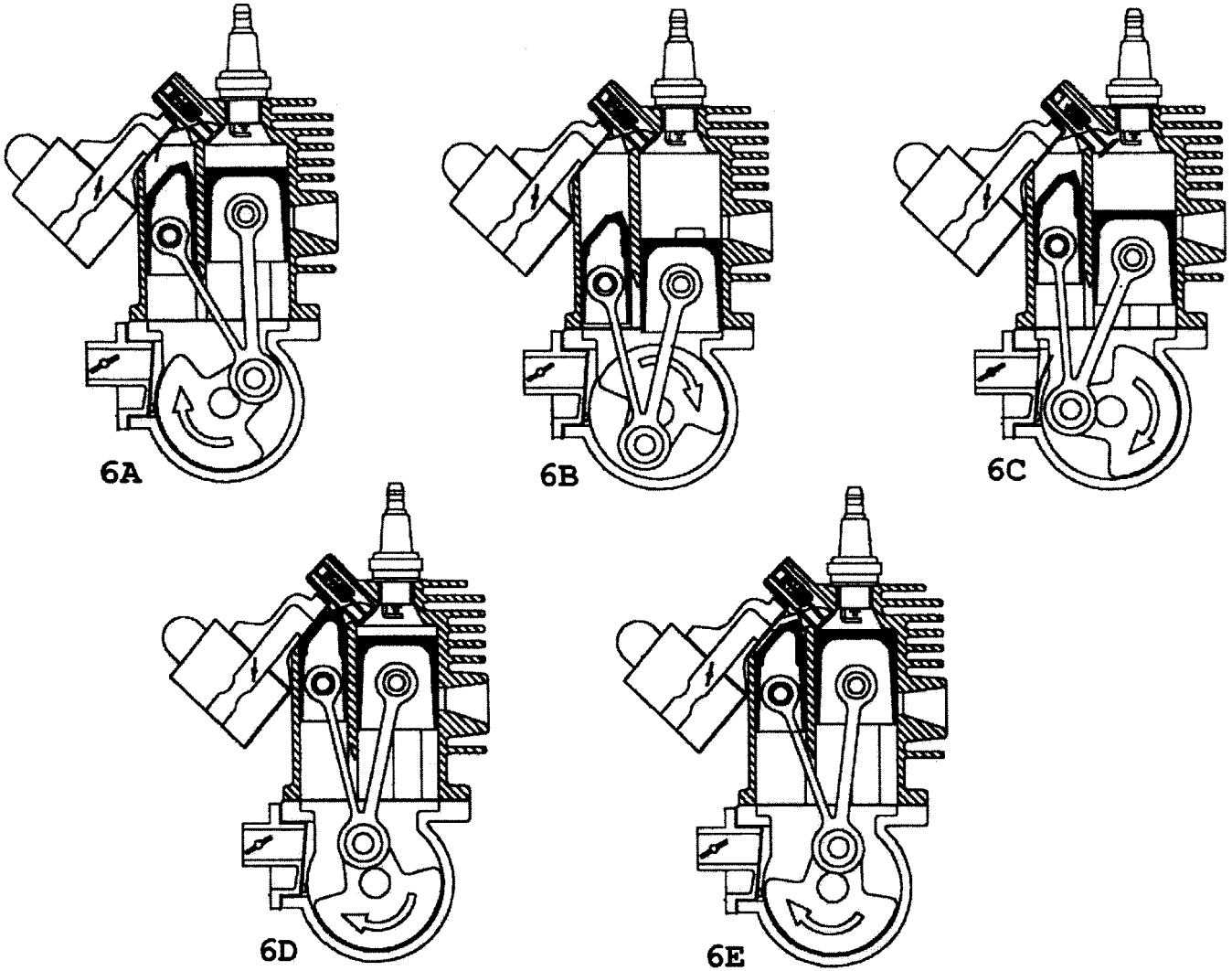
FIG. 6 illustrates the different operating stages of the engine object of this invention.

With the aforementioned engine elements, when the combustion process is initiated into the power cylinder 45, the rapidly expanding gases move the power piston towards the bottom dead center position. The rectilinear motion of the power piston 40, is transmitted to the crankpin 35 by the connecting rod main arm 38, then converted into the rotary motion by the crankshaft 34. Utilizing the energy created by the power piston 40, the slave piston 59 connected to the same crankpin 35 by the connecting rod slave arm 60, moves downwards creating a negative pressure within the pump chamber 68. As the negative pressure builds up, the air/fuel mixture crosses through the fuel inlet valve 51, by biasing the spring force that keeps it closed against the face of the inlet valve housing 53. This suction stage is illustrated by FIG. 6*a*. The suction stage within the pump cylinder 61, is simultaneous with the power stroke within the power cylinder 45. Also should be noted the small rod angle within the power piston 40, which enables most of the piston force to be transmitted to the crankpin without high trust forces over the piston and cylinder walls as illustrated by FIG. 11.

The fuel inlet valve block 53 comprises a fuel inlet passage 52 for fluid communication with the carburetor 56. The carburetor 56 contains fuel flow metering means 57 which is synchronized with the crankcase intake throttle valve 63 which regulates the flow of the scavenging fluid into the crankcase chamber 31. As the slave piston 59 reaches its bottom dead center position, the suction force decreases, the air/fuel mixture flowing through the fuel inlet valve 51 stops and the valve 51 closes. At this stage the pump cylinder 59 is completely filled with a rich air/fuel mixture. At the same time within the power cylinder 45 the power piston 40 is in the proximity of its bottom dead center position, opening the exhaust port 41. This allows the combustion gases pressurized into the power cylinder 40 to be released into a muffler 42 for their further releasing into the atmosphere. Immediately afterwards, the air into the crankcase chamber 31, already compressed by the descend of the power piston 40 and the slave piston 59, is released into the power cylinder 40 through the scavenging ports 39 located in the side of the wall of the power cylinder 45. The scavenging gas then completes the evacuation of the residual exhaust gases left into the power cylinder 45. This is commonly known as the scavenging cycle in conventional crankcase scavenged two-cycle engines and it is illustrated by FIG. 6*b*.

As typically found in loop scavenged two-cycle engines, some of the scavenging gases escape through the exhaust port 41 allowing raw hydrocarbons to be released into the atmosphere, creating an air pollution problem. There are also scavenging losses in the engine object of the present invention. Unlike to the effect of the scavenging losses in conventional two-cycle engines, the scavenging losses in this air scavenged engine, are beneficial. The oxygen contained into the scavenging air, mixes with the exhaust gases allowing the reduction of carbon monoxide into carbon dioxide, which is a harmless gas.

Figure 8:
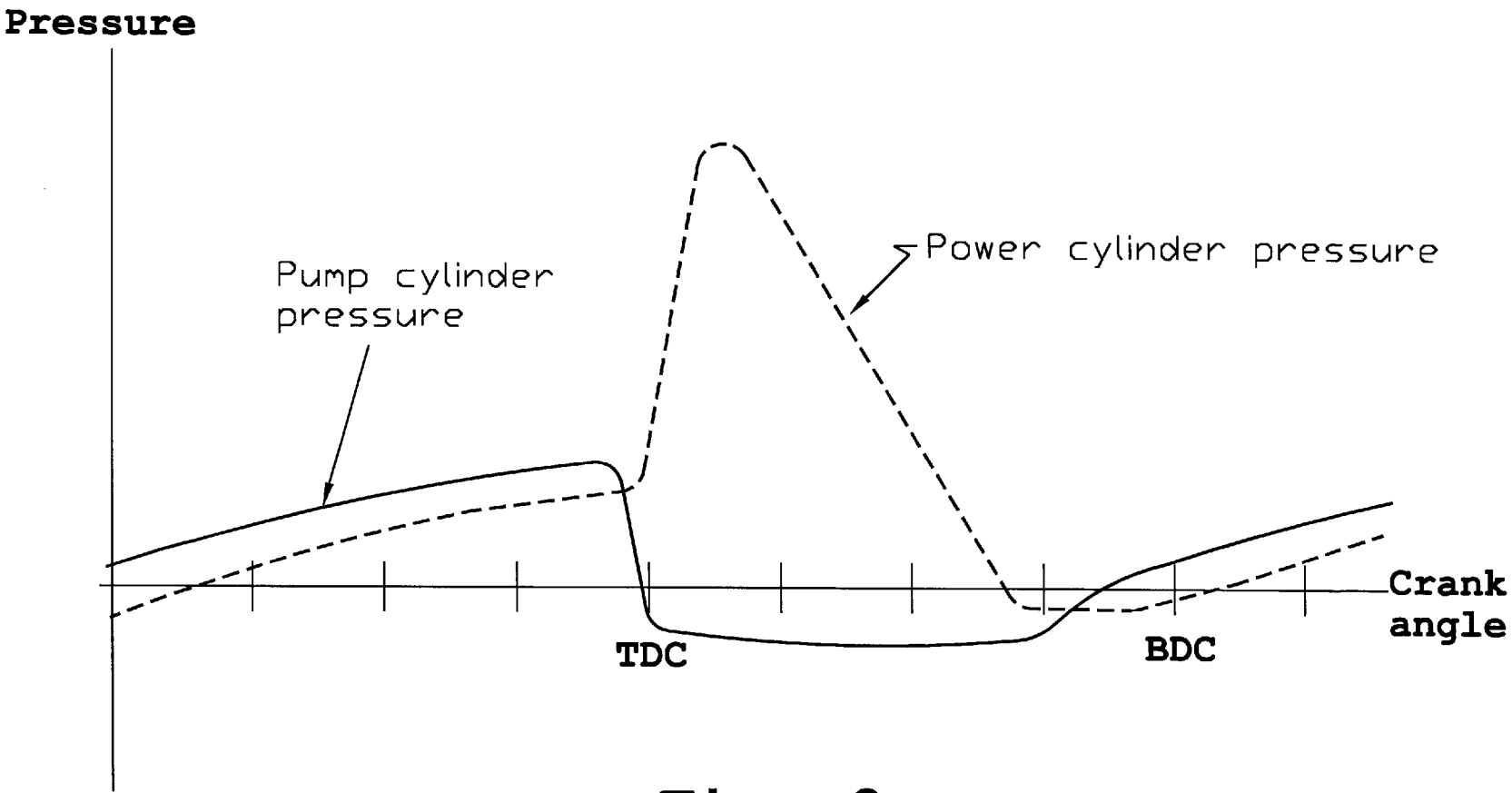
FIG. 8 shows a pressure vs. crank angle diagram during one crank revolution of the engine object of this invention.

As shown by FIG. 6*c*, after the scavenging cycle is completed, the compression cycle begins. When the slave piston 59 and the power piston 40 move upwardly driven by the inertial forces of the rotating masses of the engine, the power piston 40 starts compressing the remaining of the scavenging gas trapped into the power cylinder 45. Simultaneously, the slave piston 59 starts the compression of the rich air/fuel mixture admitted during the previous cycle. The pressure differential between the two cylinders starts building up rapidly due to the asymmetrical configuration which allows the slave piston 59 to anticipate its upward motion within the pump cylinder 61 relative to the power piston 40. FIG. 8.

Figure 7:
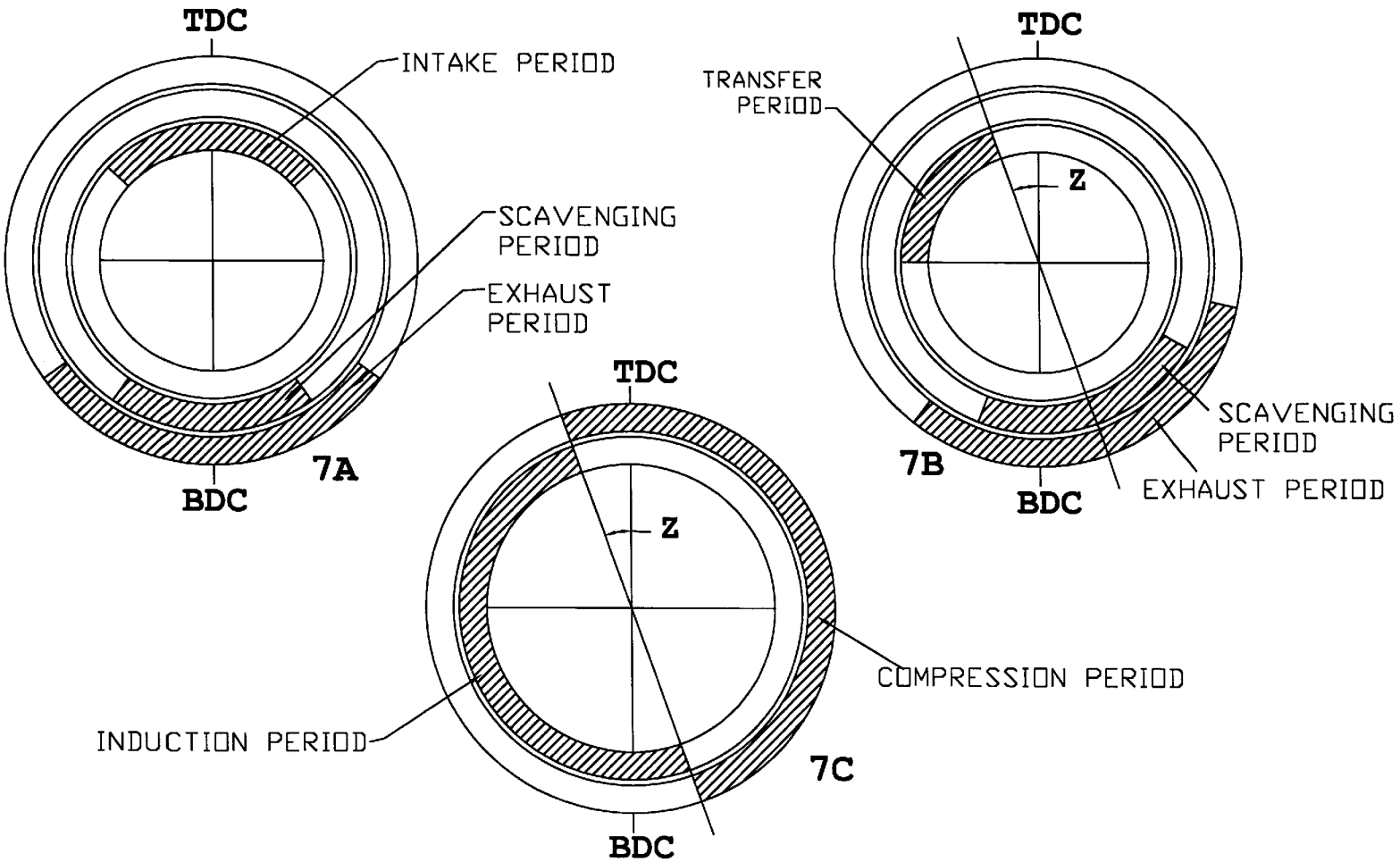
FIG. 7 shows port timing diagrams for conventional two-cycle engine and for the engine object of the present invention.

FIG. 7 shows a schematic illustration of the port timing in a typical two-cycle engine and the port timing of the engine object of the present invention. FIG. 7*a*, shows the port timing diagram for a conventional two-cycle engine. It must be noted that in a conventional two-cycle engine, the opening and closing of the ports occurs at the same angle of crank rotation before and after the top dead center (TDC) position and bottom dead center (BDC) position. This is due to the positioning of the crankshaft directly under the centerline of the cylinder, which allows the piston to travel the same distance at same crank angles from the TDC-BDC line. This special configuration is called symmetrical port timing and as shown by FIG. 7*a*. The shaded areas representing the exhaust and scavenging ports opening period, are symmetrical in both sides of the TDC-BDC line. When the crankshaft is moved away from the plane of the cylinder centerline, the port timing is shifted to one side of the TDC-BDC line. Under this condition, the opening and closing of the ports occurs at different crank angles. This geometry is called asymmetrical timing. FIG. 7*b* shows how the shaded areas representing the exhaust and scavenging ports opening period, are shifted to the right side of the [line] TDC-BDC line. Then the pistons reach BDC and TDC at different crank angle. This crank angular difference is called the phase shift "Z". The intake period within the power cylinder, is replaced by the injection period (FIG. 7*c*), which occurs after the exhaust ports are closed and before the crank reaches TDC position. The magnitude of the phase shift angle "z" is very important for the proper function of the engine object of the present invention. Systems with phase shift angle under 15 degrees will not operate with the performance factors required to meet the applications requirements.

The fuel intake period within the pump cylinder has two phases: Induction and compression phase. During the induction phase the descending motion of the slave piston within the pump cylinder creates a negative pressure differential that allows air/fuel mixture from the carburetor to enter into the pump cylinder. During the ascending motion of the slave piston, it compresses the previously admitted fluids, forcing them into the power cylinder through the transfer valve 48. This is called the compression phase. FIG. 7*c*.

Figure 1:
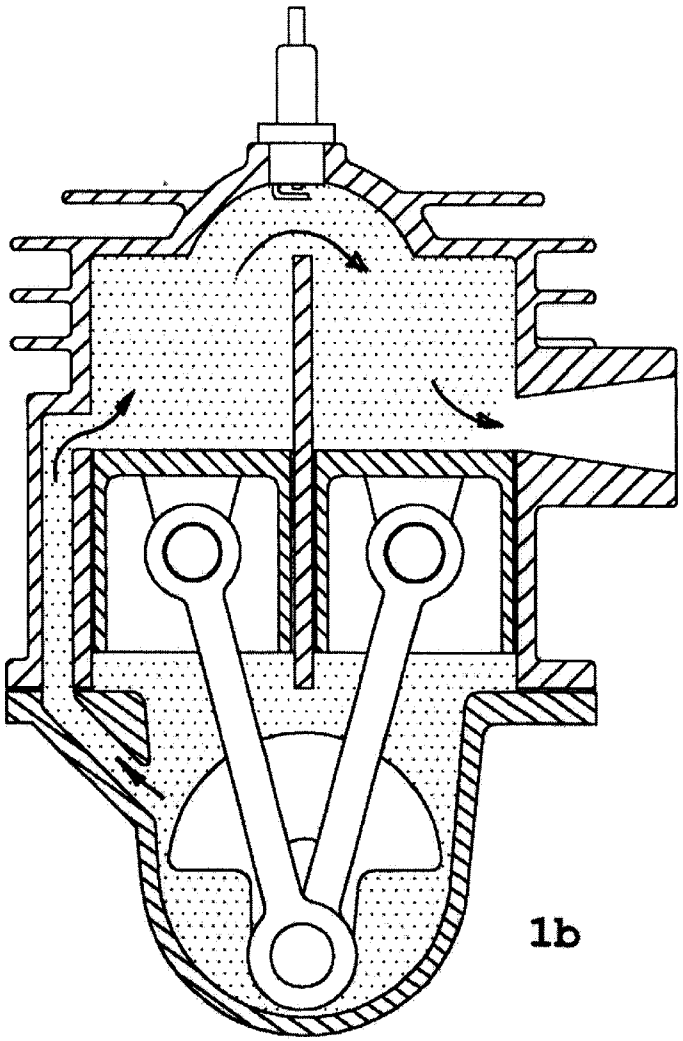
Prior art Fig. 1
FIG. 1 shows a schematic illustration of prior art two-cycle engines.
Figure 1:
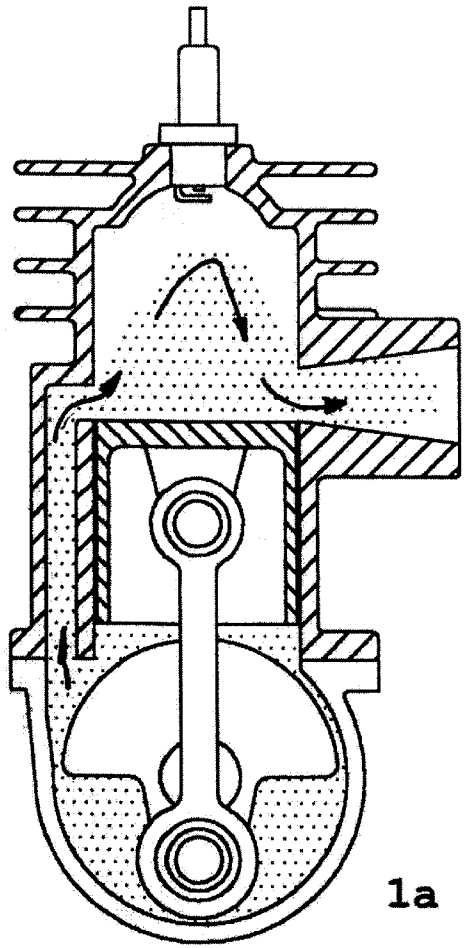
Prior art Fig. 1

Asymmetrical timing is commonly used in typical split uniflow engines, as shown in FIG. 1*b*. Uniflow engines take advantage of this kinematics to obtain a considerable advance of the opening of the exhaust port over the scavenging ports. The same geometry produces a phase shift at the TDC position which the leading piston to reach its TDC first than the trailing piston. This phase shift at TDC is of no benefit to split uniflows. On the other hand, the engine object of this invention, uses the anticipation of the leading piston at TDC to create a substantial pressure differential. This pressure diferential allows to transfer air/fuel mixture from the pump cylinder towards the power cylinder. This engine also take advantage of the BDC phase shift to improve the air trapping efficiency.

The volumetric compression ratio of the power cylinder-power piston combination is substantially smaller than the volumetric compression ratio of the pump cylinder-slave piston combination. This allows greater gas pressure within the pump cylinder than in the power cylinder during the compression cycle. The combustion chamber 46 volume is calculated to receive the swept volume of the power piston 40, added to the swept volume of the slave piston 59, in such a manner that the final gas compression values do not exceed the typical compression ratio of conventional two-cycle engines. It may be noted by the skilled in the art the obvious supercharging abilities of this engine. In utility engines, as gasoline is the preferred fuel, the final compression ratio into the power piston must no exceed certain values that may allow pre-ignition.

When the slave piston 59 approaches its top dead center, the pressure of the air/fuel mixture reaches levels substantially higher than the gases into the power cylinder. This pressure differential allows biasing the spring force holding the transfer valve 48 closed. This allows the rich air/fuel mixture to enter into the combustion chamber 46. Once the slave piston 59 reaches its top death center position, the air/fuel flow stops and the transfer valve 48 returns to the closed position. The fluid transferred into the combustion chamber 46 produces a stratified load of rich air/fuel around the spark plug, which is known to improve the initiation of the combustion process and improve flame propagation.

Immediately after the transfer valve 48 closes, the spark ignition is initiated within the combustion chamber 46. This occurs when the power piston is between 30 and 15 degrees before its top dead center as in conventional two-cycle engines. The rapid expansion of gases into the power cylinder caused by the combustion process produces the displacement of the power piston initiating the power stroke all over again as illustrated in FIG. 6*e*.

For better understanding of the gas dynamics occurring during the engine operation, FIG. 8 illustrates the change of gas pressure into the cylinders during one revolution of the engine. It can be observed how the pressure levels within the pump cylinder are substantially greater than into the power cylinder during the compression cycle. The different pressure values within the power cylinder and the pump cylinder during the compression phase are due to the pressure resistance to open the transfer valve 48. It can also be noted the effect of the combustion process causing the higher-pressure values within the power cylinder immediately after the slave piston reaches its TDC and the combustion is initiated.

As illustrated by FIG. 9*a*, the cylinder block 37 containing the two cylinder bores 45 and 61 is designed to allow high volume manufacturing processes such as die-casting. The head has been built as an integral part of the cylinder block 37 to reduce weight and cost. All the features at the top of both cylinder bores can be specifically designed to allow die cast and simple machining operations for a low cost end product. Following this manufacturing criteria, the transfer valve unit 77 can be built as a separate assembly which is fitted into the cylinder block after machining of the transfer valve bore 49.

An alternate method of construction of the cylinder head without deviating from the spirit of the present invention, is using a detachable head as shown in FIG. 9*b* in which two parts replace the cylinder block 37: the cylinder bore block 98 and the head block 99. In this configuration, there is more accessibility to the surfaces to be machined. As a result of this combination, the transfer valve elements and the transfer passage can be easily machined into the head block 99. Also the inlet reed valve 51 and the inlet passage 52 are easily placed on the cast structure.

As aforementioned, the engine object of the present invention is basically a two-cycle engine with the cantilever crankshaft system. Double supported crankshaft systems may be utilized without departing from the spirit of the present invention. Also, there is not limitation to utilize any of the scavenging or induction systems typically used by these engines such as crankcase scavenging, external scavenging, piston ported induction, reed valve induction or rotary valve induction. Following, some of these possible configurations are described.

FIG. 3 shows an engine configured with reed induction system, where the scavenging gas flow is controlled by the crankcase intake reed valve 65 mounted over the reed block 64. A crankcase throttle valve 63 controls the rate of flow of the scavenging gases entering the crankcase. The crankcase throttle valve 63 is mechanically linked to the throttle valve 57 of the carburetor 56. Both air streams entering the engine through the carburetor 56 and the reed block 64 are connected to an air filter box 58. An air filter 62 is disposed into the air filter box 58. The same functionality can be also obtained by using a double-barrel carburetor, where the crankcase intake throttle valve 63 is disposed into the secondary barrel in fluid communication with the reed block 64.

FIG. 11 shows an engine where the air/fuel intake reed valve 51 and the crankcase intake reed valve 65, have been replaced by a piston ported valve system. The air/fuel intake port 52 and the crankcase intake port 75 are in fluid communication with a double barrel carburetor 95, where the primary barrel 97 contains the means for providing a rich air/fuel mixture. Adjacent to the primary barrel 97 is the secondary barrel 96 including the crankcase intake throttle valve 63. When the slave piston 59 starts its descending motion towards its bottom dead center position, a vacuum into the pump chamber 68 is created. As soon as the top edge of the piston dome uncovers the air/fuel intake port in the side wall of the pump cylinder, a rich air/fuel mixture rushes into the pump chamber 68 initiating the pump induction_ cycle. When the slave piston starts its ascending motion towards its top dead center position, it covers the inlet valve 52 stopping the air/fuel flow into the pump chamber 68, initiating the pump compression cycle. When the slave piston is near its top dead center position, the lower edge of the slave piston skirt uncovers the crankcase intake port 75, allowing air to enter into the crankcase 31. When the slave piston starts its descending motion towards the bottom dead center position, it covers the crankcase intake port 75, initiating the crankcase compression cycle.

Figure 12:
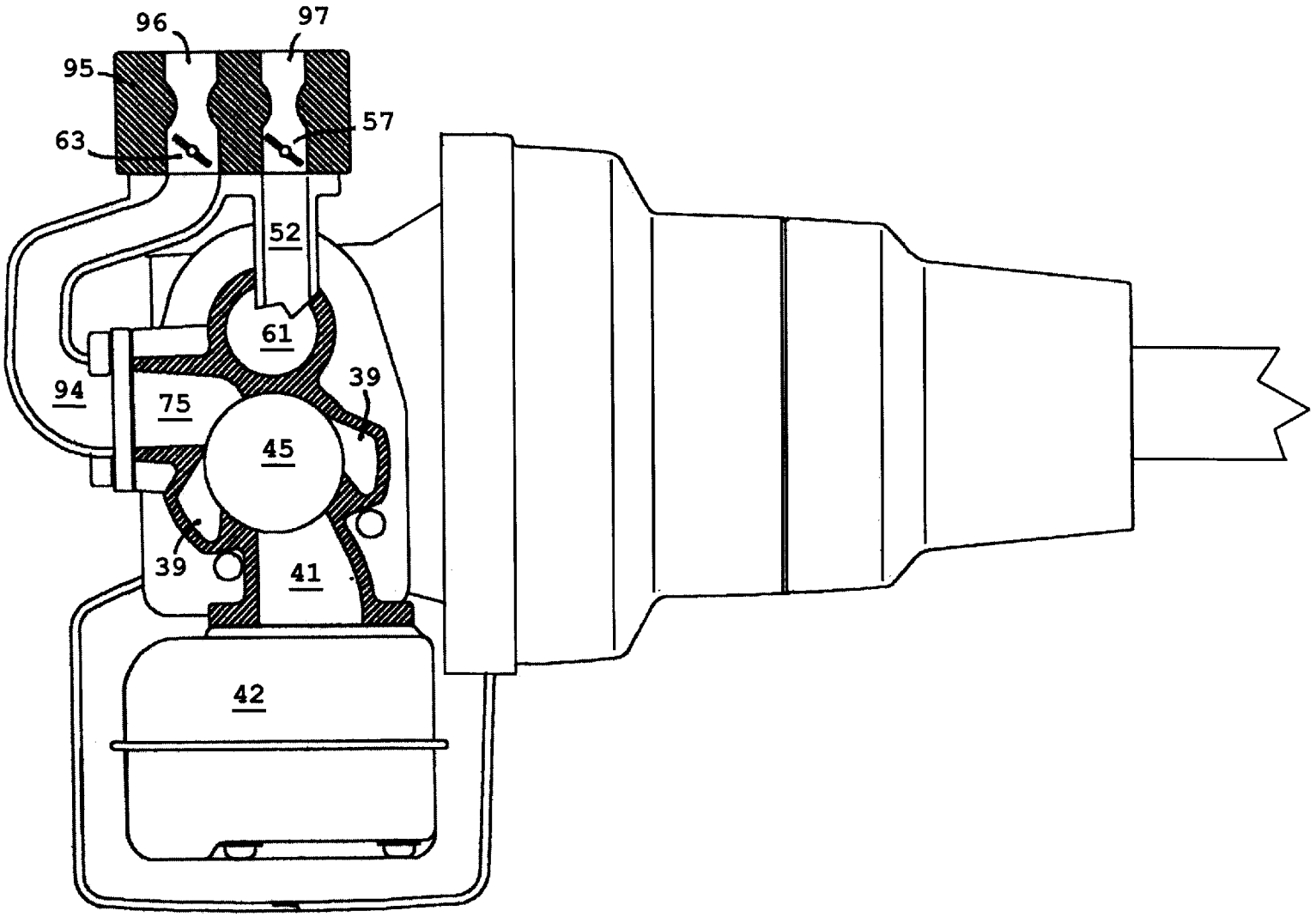
FIG. 12 shows a dual level cross section perpendicular to the cylinder axis and through the intake and exhaust ports of an engine with piston ported intake system.

FIG. 12 shows another version of the engine object of the present invention, also configured with piston ported inlet valves. Similar to conventional two-cycle engines, the crankcase intake port 75 is disposed in the side wall of the power cylinder 45 in fluid communication with the crankcase 31, wherein the displacement of the lower edge of the skirt of the power piston 40 controls the opening and closing of the intake port 75. The scavenging ports 39 are rotated to allow the placement of the crankcase intake port 75 through the wall of the power cylinder 45. The exhaust port is centered between the two scavenging ports 39. This configuration also allows the use of a piston ported air/fuel induction system similar to the system shown in FIG. 11. Similarly, the air/fuel intake is in fluid communication with the primary barrel 97 of a double barrel carburetor 95 containing means to supply a rich air/fuel mixture. Also, like in the engine of FIG. 11, the crankcase intake port is connected to the secondary barrel 96 of the double barrel carburetor 95, containing the crankcase intake throttle valve 63. Typical crankcase scavenged two-stroke engines use the pre-mix lubrication system, in which the oil is mixed with the fuel. As the air/fuel/oil mixture circulates into the crankcase, it provides the required amounts of lubrication to the sliding surfaces of the engine. As the engine object of this invention is basically air-scavenged, lubricants are not present into the scavenging gases. To circumvent this problem, very small amounts of air/fuel/oil mixture can be introduced into the crankcase with the scavenging gases to assure the lubrication of the lower components of the engine, but yet allowing very minimal effect on the total hydrocarbon emissions of such small amounts of raw gases escaping as scavenging losses. Engines where multi-position capabilities are not required, splash direct lubrication with oil recirculating system is typically used. It is obvious to the skilled in the art that the engine object of the present invention, offers unique opportunities for lubricating the internal components of the engine not offered by prior art two-cycle air-scavenged engines, such as piston timed air/fuel/oil mixture bleed into the crankcase.

Thus, from the foregoing description it should be readily apparent that the described embodiments of the invention provide a sound method of reducing unwanted emissions released into the atmosphere while still preserving the preferred characteristics of conventional two-cycle engines, which allows its use on portable equipment or applications where cost, package size, weight and emissions are the mandatory factors.

Of course, the foregoing description is that of preferred embodiments of the invention and various changes and modifications may be made without departing from the spirit and scope of the invention, as defined by the appended claims.

What is claimed is:

1. A portable tool having and engine with improved exhaust emissions, comprising:

a. a cylinder block comprising a power cylinder and a pump cylinder, said power cylinder and said pump cylinder being substantially parallel to each other;

b. an engine block having a crankcase;

c. a power piston mounted for reciprocal, linear movement within said power cylinder including at least one scavenging port, at least one exhaust port, and a combustion chamber; said combustion chamber including a valve aperture; said power piston having a wristpin; said power piston pivotally connected to a crankpin;

d. a slave piston mounted for reciprocal, linear movement within the pump cylinder; said pump cylinder including intake valve means for controlling fluid communication between a fuel/air mixing device and said pump cylinder; said slave piston having a wristpin; said slave piston pivotally connected to said crankpin;

e. at least one transfer passage extending between said power cylinder and said pump cylinder;

f. a valve for controlling fluid communication between said power cylinder and said pump cylinder;

g. a crankshaft having said crankpin eccentrically attached and a rotational axis perpendicular to a plane of motion of said power piston and said slave piston; said crankpin pivotally coupled to both pistons, said power piston and said slave piston; said rotational axis located between the centerlines of said power cylinder and said pump cylinder, said location of said rotational axis of said crankshaft resulting in a substantial offset of each pump and power cylinders centerlines with respect to said rotational axis of said crankshaft; said offset location causing asymmetric motion of each one of the pistons relative to a top and bottom dead center position of said crankshaft; said asymmetric motion of said pistons in relation to the top and bottom dead center position of said crankshaft, producing a controlled phase difference between movement of the two pistons; said controlled phase difference is such that the timing of said slave piston is substantially advanced with respect to the timing of said power piston, resulting in a substantially higher level of gas pressure into said pump cylinder in relation to the gas pressure level into said power cylinder during the compression cycle.

2. The portable tool of claim 1, wherein said power piston and said slave piston are connected to said common crankpin through their respective wristpins by a one-piece connecting rod, wherein the beam connecting said slave piston to said crankpin is elastically flexible to accommodate variations between a maximum distance between said slave piston wristpin and said power piston wristpin and a minimum distance between said slave piston wristpin and said power piston wristpin, and said beam is in a relaxed condition between said maximum wristpin distance and minimum wristpin distance; the beam connecting said power piston with said common crankpin being substantially rigid.

3. The portable tool of claim 1, wherein said common crankpin is connected to said power piston wristpin and to said slave piston wristpin by a one-piece connecting rod having two substantially rigid beams; at least one of said connecting rod beams includes a wristpinhead having an eccentric collar sandwiching between said wristpin and a wristpinhead eye; said eccentric collar being slidably with respect said wristpin and said wristpinhead eye, whereby rotational changes of said eccentric collar with respect said wristpinhead eye accomodates for distance variations between said power piston wristpin and said slave piston wristpin.

4. The portable tool of claim 1, further including at least two intake ports, a fuel supply intake port in fluid communication with a pump chamber disposed within the pump cylinder and a crankcase intake port in fluid communication with the crankcase; said intake ports comprising valve means for controlling unidirectional flow in unison with the engine.

5. The portable tool of claim 4, wherein said crankcase intake port is disposed in the side wall of said power cylinder, whereby opening and closing of said crankcase intake port is controlled by displacement of the lower edge of the power piston skirt.

6. The portable tool of claim 4, wherein said crankcase intake port is disposed in the side wall of said pump cylinder, whereby opening and closing of said crankcase intake port is controlled by displacement of the lower edge of the slave piston skirt.

7. The portable tool of claim 1, having a one-piece connecting rod coupling said common crankpin to said power piston and a one-piece connecting rod coupling said common crankpin to said slave piston.

8. The portable tool of claim 1, wherein the slave piston dome surface is shaped to follow the internal features on top of the pump cylinder, resulting in minimal clearance between said slave piston dome surface and said pump cylinder end surface when said slave piston is at Top Dead Center position, whereby significantly reducing dead spaces and pumping losses.

9. The portable tool of claim 1, wherein said pump cylinder and said power cylinder are parallel within a 20 degree angle over the length of said power cylinder and said pump cylinder.

10. The power tool of claim 1, wherein said valve for controlling fluid communication between said power cylinder and said pump cylinder, is disposed into a integral transfer valve unit assembly.

11. A two-cycle, spark ignited internal combustion engine with improved exhaust emissions comprising:

a. an engine block including a crankcase;

b. a cylinder block including a power cylinder and a pump cylinder, said power cylinder and said pump cylinder being substantially parallel; said power cylinder including at least one scavenging port, at least one exhaust port and a combustion chamber; said combustion chamber including a valve for controlling fluid communication between said power cylinder and said pump cylinder; said pump cylinder including a valve for controlling the timing of the air/fuel mixture entering the pump cylinder in unison with the engine;

c. a power piston and a slave piston mounted for reciprocal, linear movement within said power cylinder and said pump cylinder respectively; said slave piston having a diameter substantially smaller than the power piston; said slave piston and said power piston having each a wristpin;

d. a crankshaft having an eccentric crankpin and a rotational axis perpendicular to a plane of motion of said power cylinder and said pump cylinder, said rotational axis disposed in between the power cylinder axis and the pump cylinder axis; said location of said rotational axis of said crankshaft results in a substantial offset of each pump and power cylinders centerlines with respect to the rotational axis of said crankshaft; said offset location causing asymmetric motion of each one of the pistons relative to a top and bottom dead center position of said crankshaft; said asymmetric motion of said pistons in relation to the top and bottom dead center position of said crankshaft, producing a controlled phase difference between movement of the two pistons; said controlled phase difference is such that the timing of the slave piston is substantially advanced with respect to the timing of the power piston, resulting in a substantially higher level of gas pressure into the pump cylinder in relation to the gas pressure level into the power cylinder during the compression cycle;

e. connecting rod means for pivotally connecting said power piston to said crankpin and said slave piston to the said crankpin, wherein said connecting rod means having at least a wristpin eye and a crankpin eye; said crankpin eye and said wristpin eye joined by a single beam; said crankpin eye to attach said beam to said crankpin and said wristpin eye to attach said beam to said slave piston wristpin or to said power piston wristpin; said crankpin being commonly coupled to both said slave piston and said power piston;

f. at least one crankcase intake port; said crankcase intake port including valve means for controlling the timing of the scavenging gases entering the crankcase in unison with the engine.

12. The portable tool of claim 11, wherein said connecting rod means comprising a one-piece forked connecting rod having two beams; a first beam connecting said power piston to said crankpin, and a second beam connecting said slave piston to said common crankpin; said second beam connecting said slave piston to said common crankpin being elastically flexible to accomodate variations between a maximum distance between said slave piston wristpin and said power piston wristpin and a minimum distance between said slave piston wristpin and said power piston wristpin, and said beam is in a relaxed condition between said maximum wristpin distance and minimum wristpin distance; said first-beam connecting said power piston to said common crankpin being substantially rigid.

13. The portable tool of claim 11, wherein said connecting rod means comprising a one-piece member having two subtantially rigid beams; a first beam connecting said common crankpin to said power piston and a second beam connecting said common crankpin to said slave piston; said first and second beams pivotally coupled to said slave piston and said power piston by wrispins; at least one of said connecting rod beams includes a wristpinhead having an eccentric collar sandwiching between said piston wristpin and a wristpinhead eye; said eccentric collar being slidably with respect said piston wristpin and said wristpinhead eye, whereby rotational changes of said eccentric collar with respect said wristpinhead eye accomodates for distance variations between said power piston wristpin and said slave piston wristpin.

14. The two-cycle engine of claim 11, wherein said valve for controlling fluid communication between said pump cylinder and said power cylinder is disposed over a integral valve unit assembly.

15. The two-cycle, engine of claim 11, wherein said slave piston having a dome shaped to follow the features at the end surface of the pump cylinder, resulting in very small dead spaces when said slave piston is at top dead center, whereby reducing pumping losses.

16. The two-cycle, engine of claim 11, wherein said cylinder block is comprised by two elements, a cylinder bore block and a cylinder head block; said cylinder head block disposed at one of the open ends of said cylinder bore block, said cylinder bore block including said power cylinder and said pump cylinder, said cylinder head including said combustion chamber.

17. The two-cycle, engine of claim 11, further comprising means to provide a predetermined quantities of fuel/oil mixture into said crankcase, whereby adequate lubrication can be provided to internal components of the engine.

18. The two-cycle engine of claim 11, whereby said crankcase intake port is disposed over the pump cylinder wall.

19. The two-cycle engine of claim 11, wherein said crankcase intake port is disposed in the side wall of said power cylinder, whereby opening and closing of said crankcase intake port is controlled by displacement of the lower edge of the power piston skirt.

20. The two-cycle engine of claim 11, wherein said pump cylinder and said power cylinder are parallel within a 20 degree angle over the length of said power cylinder and said pump cylinder.

* * * * *